US010188188B2

(12) United States Patent
Passarello

(10) Patent No.: US 10,188,188 B2
(45) Date of Patent: Jan. 29, 2019

(54) HEADBAND WITH A 360-DEGREE ELASTIC OUTSIDE PORTION JOINED WITH A 360-DEGREE VELVET INSIDE LINING

(71) Applicant: SPARKLY SOUL, INC., New York, NY (US)

(72) Inventor: Dari Passarello, New York, NY (US)

(73) Assignee: Sparkly Soul, Inc., Westport, CT (US)

( * ) Notice: Subject to any disclaimer, the term of this patent is extended or adjusted under 35 U.S.C. 154(b) by 0 days.

(21) Appl. No.: 15/217,361

(22) Filed: Jul. 22, 2016

(65) Prior Publication Data

US 2016/0345706 A1 Dec. 1, 2016

Related U.S. Application Data

(63) Continuation-in-part of application No. 14/815,289, filed on Jul. 31, 2015, and a continuation-in-part of application No. 13/978,391, filed as application No. PCT/US2012/048081 on Jul. 25, 2012, now Pat. No. 9,173,467.

(60) Provisional application No. 61/512,696, filed on Jul. 28, 2011.

(51) Int. Cl.
*A45D 8/00* (2006.01)
*A45D 8/36* (2006.01)

(52) U.S. Cl.
CPC ..... *A45D 8/36* (2013.01); *A45D 2008/004* (2013.01); *Y10T 29/49872* (2015.01)

(58) Field of Classification Search
CPC ..... A45D 8/36; A45D 8/00; A45D 2008/004; A45D 2008/006; A45D 2008/002; A41D 20/00
See application file for complete search history.

(56) References Cited

U.S. PATENT DOCUMENTS

| | | | |
|---|---|---|---|
| D4,516 | S | 12/1870 | Smith |
| 354,882 | A | 12/1886 | Bracher |
| 409,001 | A | 8/1889 | Ashworth |
| D19,530 | S | 12/1889 | LaPierre |
| 478,291 | A | 7/1892 | Sprier |
| 497,085 | A | 5/1893 | Yule et al. |

(Continued)

FOREIGN PATENT DOCUMENTS

| | | |
|---|---|---|
| CA | 144200 | 11/2012 |
| CN | 2678415 Y | 2/2005 |

(Continued)

OTHER PUBLICATIONS

International Search Report of PCT/US2016/045062 dated Oct. 6, 2016.

(Continued)

*Primary Examiner* — Rachel R Steitz
(74) *Attorney, Agent, or Firm* — Fish & Richardson P.C.

(57) ABSTRACT

A headband is provided that includes an elastic outside and an inside lining. A top portion of the elastic outside forms the outside of the headband and has an elasticity. A bottom portion of the inside lining forms the inside of the headband and has an elasticity. Both the elastic outside and the inside lining are connected to make the headband a 360-degree elastic headband. At least the bottom portion of the inside lining includes a velvet material that forms a gripping portion. The elastic outside and the inside lining provide an elastic headband.

12 Claims, 8 Drawing Sheets

(56) References Cited

U.S. PATENT DOCUMENTS

| | | | | |
|---|---|---|---|---|
| 1,156,487 | A | 10/1915 | Kunstadter | |
| 2,116,082 | A | 5/1938 | Radford | |
| 2,294,654 | A | 9/1942 | Cooper | |
| 2,343,408 | A | 3/1944 | Glass | |
| 2,351,132 | A | 6/1944 | Kling | |
| 2,406,700 | A | 8/1946 | Miller | |
| 2,580,323 | A | 12/1951 | Russell | |
| 3,229,308 | A | 1/1966 | Jensen | |
| 3,467,111 | A * | 9/1969 | Benson | A45D 8/00 132/273 |
| 3,474,798 | A | 10/1969 | Tillotson | |
| 3,672,362 | A * | 6/1972 | Basche | A45D 44/22 606/204.35 |
| 4,317,238 | A | 3/1982 | Amin | |
| 4,416,633 | A | 11/1983 | Gulack | |
| D272,865 | S | 3/1984 | Edelmann | |
| 4,499,741 | A | 2/1985 | Harris | |
| 4,630,317 | A | 12/1986 | Brown | |
| 4,811,430 | A | 3/1989 | Janusz | |
| 4,833,734 | A | 5/1989 | Der Estephanian | |
| 4,910,806 | A | 3/1990 | Baker et al. | |
| 4,918,758 | A * | 4/1990 | Rendina | A63F 9/0098 2/171 |
| 4,947,488 | A | 8/1990 | Ashinoff | |
| D316,774 | S | 5/1991 | Falk | |
| 5,111,975 | A | 5/1992 | Roberts | |
| D343,282 | S | 1/1994 | Irish | |
| D351,052 | S | 10/1994 | Russell | |
| D355,047 | S | 1/1995 | Grimes | |
| D375,612 | S | 11/1996 | Elder | |
| 5,579,540 | A | 12/1996 | Walker | |
| D382,989 | S * | 9/1997 | Simpson | D2/894 |
| D384,790 | S | 10/1997 | Juergens | |
| D389,636 | S | 1/1998 | Davis | |
| 5,806,535 | A | 9/1998 | Becker | |
| D402,091 | S | 12/1998 | Bratcher | |
| 5,848,981 | A | 12/1998 | Herbranson | |
| 5,862,523 | A | 1/1999 | Proctor | |
| 5,963,989 | A * | 10/1999 | Robertson | A41D 20/00 2/171 |
| 6,000,062 | A | 12/1999 | Trakh | |
| 6,115,843 | A | 9/2000 | Travalgia | |
| 6,205,590 | B1 | 3/2001 | Gorman | |
| 6,227,011 | B1 | 5/2001 | Cortinovis | |
| 6,237,611 | B1 | 5/2001 | LeCrone | |
| 6,295,992 | B1 * | 10/2001 | Sapp | A45D 8/34 132/200 |
| 6,502,245 | B1 | 1/2003 | McBride | |
| 6,553,577 | B2 | 4/2003 | Montague | |
| 6,701,532 | B1 | 3/2004 | Glassberg et al. | |
| D497,467 | S | 10/2004 | Srivastava | |
| D511,036 | S | 11/2005 | Moses | |
| D519,716 | S | 5/2006 | Smith | |
| D528,744 | S | 9/2006 | Nelson | |
| 7,398,559 | B2 | 7/2008 | Flatt | |
| D578,742 | S | 10/2008 | Cho | |
| D668,843 | S * | 10/2012 | Lalonde | D2/881 |
| 8,276,216 | B2 | 10/2012 | Carney | |
| 9,392,827 | B2 | 7/2016 | Farney | |
| 2002/0043077 | A1 * | 4/2002 | Boyadjian | A44C 5/0069 63/3 |
| 2002/0055317 | A1 | 5/2002 | Kopelowicz | |
| 2003/0121127 | A1 * | 7/2003 | Walker | A41D 20/00 24/306 |
| 2003/0131395 | A1 | 7/2003 | Putnam | |
| 2003/0221241 | A1 | 12/2003 | Rivera | |
| 2004/0213979 | A1 | 10/2004 | Vito et al. | |
| 2005/0061345 | A1 | 3/2005 | Srivastava | |
| 2005/0222608 | A1 * | 10/2005 | Hou | A61H 39/04 606/204 |
| 2006/0032515 | A1 * | 2/2006 | Thall | A45D 8/40 132/274 |
| 2006/0042139 | A1 | 3/2006 | Mendes | |
| 2006/0085891 | A1 * | 4/2006 | Larkin | A45D 8/36 2/171 |
| 2006/0162046 | A1 * | 7/2006 | Chudzik | A45D 8/36 2/174 |
| 2006/0249172 | A1 | 11/2006 | Ballew | |
| 2008/0022438 | A1 | 1/2008 | Schweers et al. | |
| 2008/0156340 | A1 * | 7/2008 | Hopper | A45D 8/36 132/275 |
| 2009/0090378 | A1 | 4/2009 | Chudzik et al. | |
| 2010/0107307 | A1 | 5/2010 | Lee | |
| 2010/0162464 | A1 | 7/2010 | Beard | |
| 2010/0206323 | A1 | 8/2010 | August | |
| 2010/0242980 | A1 * | 9/2010 | D'Assis | A45D 8/34 132/200 |
| 2012/0118317 | A1 * | 5/2012 | Payne | A45D 8/00 132/275 |
| 2012/0180193 | A1 | 7/2012 | Curiel | |
| 2012/0234344 | A1 * | 9/2012 | Hsu | A45D 8/36 132/273 |
| 2013/0291887 | A1 | 11/2013 | Passarello | |
| 2016/0029722 | A1 | 2/2016 | Klopfer | |
| 2017/0164662 | A1 | 6/2017 | Carney | |

FOREIGN PATENT DOCUMENTS

| | | |
|---|---|---|
| CN | 201700449 U | 1/2011 |
| CN | 302193829 | 11/2012 |
| EM | 001311914-0001 | 3/2012 |
| GB | 2184754 | 7/1987 |
| GB | 2 318 500 | 4/1998 |
| RU | 82529 U1 | 5/2009 |

OTHER PUBLICATIONS

"Come to diamond's this week . . . and leave 10 years behind!", [online] Diamonds; Tue Mar. 30, 1971; Arizona Republic, Downloaded on Dec. 17, 2017 (1 page).

EPO Search Report for EP App No. 12818075.9, dated Oct. 20, 2015 (8 pages).

Goody Hair Bands (Gold and Burgundy Glitter), "Crowning Glory", Beauty Marie Claire, Marie Claire Magazine Dec. 2008, p. 150.

International Search Report for Int. App No. PCT/US2012/048081, dated Oct. 11, 2012 (2 pages).

International Search Report for Int. App No. PCT/US2016/045062, dated Oct. 6, 2016 (2 pages).

Lorraine Basche press photo, Face Up Hairbands; [online]; HistoricImages, (1 page).

Newspapers.com [online] "Demonstrations Scheduled for new Beauty Item", The Journal News (Hamilton, Ohio), Mon, Jun. 9, 1975, p. 5, Downloaded on Dec. 13, 2017 (1 page).

Newspapers.com [online], "Beauty Aid Like Mummy's", The Sydney Morning Herald (Sydney, New South Wales, Australia), Tue, Mar. 26, 1974, p. 14, Downloaded on Dec. 13, 2017 (1 page).

Newspapers.com [online], "Casa Linda Club Hears Program on 'Face Up' at Regular Meet", The Mexia Daily News (Mexia, Texas), Sun, Apr. 22, 1973, p. 2, Downloaded on Dec. 13, 2017 (1 page).

Newspapers.com [online], "Headband Erases Years from Face", The Daily Times-News (Burlington, North Carolina), Wed, Sep. 19, 1973, p. 23, Downloaded on Dec. 13, 2017 (1 page).

Newspapers.com [online], "Lorraine Basche Faces-Up to Her Age", Honolulu Star-Bulletin (Honolulu, Hawaii), Fri, Jul. 10, 1970, p. 23 Downloaded on Dec. 13, 2017 (2 pages).

Newspapers.com [online], "Lorraine Faces Up to Age Lines", The Tennessean (Nashville, Tennessee), Tue, Nov. 7, 1972, p. 17, Downloaded on Dec. 13, 2017 (1 page).

Newspapers.com [online], "New Beauty Aid Claimed: Instantaneous Face Lift", The Courier-News (Bridgewater, New Jersey), Wed, Sep. 20, 1972, Main Edition, p. 17, Downloaded on Dec. 13, 2017 (1 page).

Newspapers.com [online], "What Instant Face Lift Taut Me: The Sag Will Eventually Return", The Philadelphia Inquirer (Philadelphia, Pennsylvania), Mon, Jan. 21, 1974, Main Edition, p. 6, Downloaded on Dec. 13, 2017 (1 page).

(56) References Cited

OTHER PUBLICATIONS

Newspapers.com; [online] "Come to McAlpin's This Week . . . Go Home Looking Years Younger with the Face-Up Headband!", The Cincinnati Enquirer (Cincinnati, Ohio); Sun, Jun. 8, 1975; The Kentucky Enquirer, p. 140; Downloaded on Dec. 17, 2017 (1 page).
SIPO Office Action for CN App No. 201280047814.X dated Mar. 1, 2016 (14 pages).
Sparkly Soul—Fitness Headbands, [on-line]; [posted to the Internet Feb. 22, 2013]; [retrieved from the Internet Nov. 8, 2016]; URL: < https://www.youtube.com/watch?v=3aHOyaajxo4&feature=youtu.be> (2 pages).
Sparkly Soul, photo post [online]; [posted to the Internet Jul. 31, 2011]; [retrieved from the Internet Nov. 8, 2016]; URL: https://www.facebook.com/sparklysoulinc/photos/a.263148203702249.85880.263148047035598/263148210368915/?type=3&theater (1 page).
Sparkly Thin Headband, [online]; [posted to the Internet with a crawlback date of Oct. 6, 2011]; [retrieved from the Internet Nov. 8, 2016]; URL: < https://web.archive.org/web/20111006045951http://shop.sparklysoul.com/SparklySmallHeadband_c2.htm > (3 pages).

* cited by examiner

HEADBAND WITH A 360-DEGREE ELASTIC OUTSIDE PORTION JOINED WITH A 360-DEGREE VELVET INSIDE LINING

CROSS REFERENCE TO RELATED APPLICATIONS

This application is a continuation-in-part of U.S. patent application Ser. No. 14/815,289, which was filed on Jul. 31, 2015, which is a continuation-in-part patent application that claims priority to U.S. patent application Ser. No. 13/978,391 (now U.S. Pat. No. 9,173,467), which was filed in the U.S. Patent and Trademark Office on Jul. 30, 2013, which is a national stage patent application of International Patent Application No. PCT/US12/48081, filed on Jul. 25, 2012, which claims priority to U.S. Provisional Patent Application No. 61/512,696, which was filed in the U.S. Patent and Trademark Office on Jul. 28, 2011, all of which are incorporated herein by reference in their entirety for all purposes.

FIELD OF INVENTION

The embodiments of the present disclosure relate generally to a headband that includes: a full-circular/360-degree stretch velvet inside lining joined with a full-circular/360-degree elastic outside portion. This elastic outside includes, but is not limited to, any ribbon or material that is a metallic, print, pattern or solid elastic. The headband has no-headache and no-slip properties providing a soft and secure fit. It is particularly beneficial to athletes and active individuals having a "stay-put" quality during sports and fitness activities.

BACKGROUND OF INVENTION

Headbands are widely used by a variety of people, including athletes and others with long hair, with one of the purposes of the headband being to keep hair out of the wearer's field of vision. Headbands are conventionally found in a variety of styles and are popular among girls and women.

Headbands may be made of various materials. Often, the designs of the headbands have problems with slipping or creating a headache for the wearer.

Some headbands are made from rigid materials and are oblong in shape with an opening at the bottom end to slide over the head of the wearer where each end fits behind the wearer's ear to secure itself in place by pressure behind the ear. These styles can often cause the wearer discomfort as pressure is felt from the point of contact behind the ears.

Styles of headbands can include a wraparound style headband that include a portion of a circular piece of elasticized material, which is secured in place by pressure from the elastic band as the elastic constricts around the head and hair of the wearer. These bands often slide off the wearer's head because there is no gripping ability.

Alternatively, many headbands of the prior art use a piece of black elastic attached to an inflexible ribbon to provide the "stretch" on a headband. The piece of black elastic is at the base of the head. While these headbands are marketed as "no slip," there is still a degree of slipping as the black elastic is being pulled on both sides from the pulling from the static ribbon once placed on the head. The black elastic band typically becomes stretched out after a few uses. These products also cause a "headband headache" due to lack of elasticity and ride up the back of the head and irritate behind the ears where the static ribbon ends.

Further, another popular category of headbands are headbands that are made of Lycra, fashion fabric or sweat wicking material. Such headbands tend to simply slide right off a user's head and do not remain secure for prolonged wear.

Others types of headbands have a silicone inside lining to prevent slipping. These headbands often break and snag hair.

There is a continuing unmet need for headbands that are comfortable during prolonged wear and remain secure, as well as functional and stylish, during vigorous activity.

BRIEF DESCRIPTION OF THE DRAWINGS

Preferred features of embodiments of the present invention are disclosed in the accompanying drawings, wherein similar reference characters denote similar elements throughout the several views, and wherein.

DETAILED DESCRIPTION

Figure 1A:
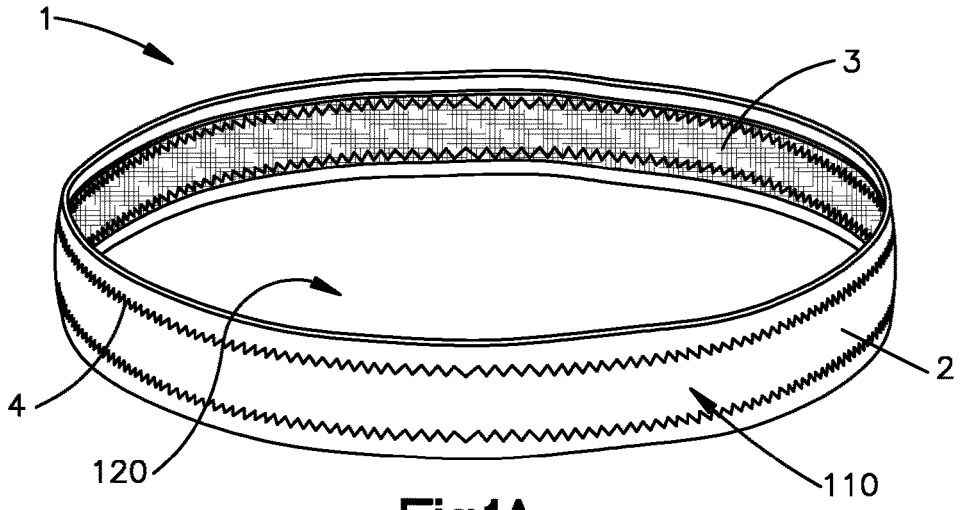
FIG. 1A shows an example of a headband where the elastic outside has a greater width than the inside lining.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "upper," "lower," "inside," "outside" and the like, are words of convenience and are not to be construed as limiting terms. "Substantially" means being largely but not necessarily wholly that which is specified. The term "material" is any material, including ribbon or fabric, that is laser cut to a desired width, cut and/or folded to a desired width to be provided on the outside of the headband. The "material" can also be obtained at the desired width; for example, the material is obtained already at an existing width that is desired. In other examples, the material can be manipulated in any way to achieve a desired width. While the disclosure below refers to "ribbon," "material," or "ribbon or material," the term "material" can also be construed to include any of the above terms or phrases.

Preferred features of the embodiments of the present invention are disclosed in the accompanying drawings. The figures provided herein generally depict a headband that includes a full-circular/360-degree stretch velvet inside lining joined with a full circular/360-degree elastic outside which include, but are not limited to, any ribbon or material that have a metallic, print or solid elastic outside. The headband has no slip and no headache properties.

The figures provided herein show a headband that improves grip on a wearer's head because of its no slip and no headache features, and provides an aesthetically appealing headband with a preferred full-circular/360-degree elastic outside.

Applicant, as her own lexicographer, notes that the use of "full-circular 360-degree stretch velvet inside lining joined with a full-circular/360-degree elastic outside" includes headbands with 270-degrees (e.g., three quarters of 360-degrees) to 360-degrees of stretch velvet inside lining. The velvet inside lining need not be continuous. There may be breaks in the velvet (i.e. no velvet area); however, if combined into one strip, the stretch velvet inside lining cumulatively spans between about 270-degrees and about 360-degrees of the headband and still encompasses this present disclosure. Applicants are taking this approach because there are "copy cats" that may copy the aspects of Applicants invention but not necessarily include an inside lining that is completely 360-degrees around. In an effort to avoid such a design around, Applicants submit that the scope of this invention cover an inside velvet lining that encompasses from 270-degrees to 360-degrees including, for example, 300-degrees. For example, the inside lining can be made of four strips with breaks in between each strip. However, the strips, if combined, cumulatively span at least 270-degrees of the circle created by the headband. The velvet inside lining may be located in one area or multiple areas. For example, the velvet inside lining can be one strip and can be placed in substantially the middle of the headband. The velvet inside lining can be like a river spanning the middle of the inside of the headband. The river can have different widths and be narrower or wider while staying within or equal to the width of the elastic outside. For example, the river can span the entire width of the elastic outside or the river can be narrower such that the elastic outside ribbon or material can be seen on either side of the velvet inside lining. In other examples, the velvet inside lining can be two or more strips that run substantially parallel to one another, similar to train tracks. In yet other examples, the velvet inside lining can be more than two strips. However, it will be appreciated by a person of ordinary skill in the art that this application also includes a partial velvet inside lining i.e. the inside includes velvet on 75% or 95% of the inside of an entirely elastic headband.

In at least one embodiment of the present invention, a headband includes: a full-circular/360-degree elastic outside. The elastic outside spans the entire circular or 360-degrees of the headband. This outside portion forms the outside of the headband, where a trim, ribbon or material is used that has elasticity. The material can be a wide variety of materials as long as the material has elasticity. The headband also preferably includes a full-circular/360-degree stretch velvet inside lining. This inside lining forms the inside of the headband, wherein a stretch velvet ribbon or material is used that has elasticity. The outside elastic ribbon or material portion is attached to the stretch velvet ribbon or material inside lining. This maintains the elasticity of the headband having a soft and secure hold.

As depicted in the figures, the headband of an embodiment of the present invention is made from an elastic ribbon or material connected to a stretch velvet ribbon or material using a securing method which may include, but not be limited to, stitching and/or bonding. Although the headbands as described herein are made by hand, it is understood that claim recitations in patent applications cover future, prospective designs including machines deployed in the future to attach the two ribbons and/or materials. Also, automated methods and machines may be used for cutting and cleaning processes such as used for loose threads.

The inside surface of the stretch velvet inside lining forms the inside surface of the headband. In an embodiment of the present invention, the bottom surface of the stretch velvet is made of a ribbon or material. The velvet inside lining prevents slipping on a wearer's head. Additionally, the velvet inside lining of the headband creates a comfortable feel on a wearer's head so as not to cause a headband headache. If the velvet bottom surface of the stretch velvet ribbon or material was not present in an embodiment of the present invention, any plain ribbon or material (elastic or not) would slip right off a wearer's head. This is because the velvet material acts to grip the hair of the wearer. This is especially true when exercising.

In at least one embodiment of the present invention, the stretch velvet ribbon or material is lush with a resplendent look and has the elasticity required for the headband of the embodiments of the present invention. The velvet inside lining is elastic and has the ability to stretch without breaking. The stretch velvet inside lining ribbon or material may be a variety of colors and a variety of sizes. The stretch velvet inside lining can be the same or a smaller width as the elastic outside. The stretch velvet inside lining is preferably made of approximately 80% polyamide and approximately 20% elastomer (a person of ordinary skill in the art will understand that "approximately" used in this context means "within a few percentage points"). In other embodiments of the present invention the stretch velvet inside lining is made of approximate 95% polyamide and approximately 5% elastomer; alternately 90% polyamide and 10% elastomer; alternately 85% polyamide and 15% elastomer. In yet other embodiments of the present invention, the stretch velvet inside lining is made of approximately 75% polyamide and approximately 25% elastomer; alternately 70% polyamide and 30% elastomer. An elastomer can be a natural or synthetic polymer having elastic properties, for example, spandex or LYCRA®. However, one skilled in the art will understand that the embodiments of the present invention are not limited to the materials described herein for either the elastic outside ribbon or material or the stretch velvet inside lining ribbon or material. The stretch velvet inside lining ribbon and/or material can include variations of composition of polyester, nylon and spandex/elastane/LYCRA®. In yet other embodiments of the present invention, the stretch velvet inside lining can include velveteen or velour.

The embodiments of the present invention are improvements from the headbands of the prior art. For example, many headbands do not stretch for 360-degrees of the headband—they use a piece of black elastic on the back of the headband to provide the "stretch" on the headband. Additionally, the gripping portion of prior art headbands does not wrap around the entire head of the wearer—the headband stops and the remainder is plain elastic. While many headbands in the market characterize their headbands as "no slip," there is still a degree of slide due to the grip not going all the way around the headband, and therefore not going all the way around the wearer's head. These headbands cause a headband headache due to their lack of elasticity.

The embodiments of the present invention may be manufactured in many different colors and/or color combinations. For example, in an embodiment of the present invention, the elastic outside ribbon or material and the stretch velvet inside lining ribbon or material may be color coordinated, and in another embodiment they may include different colors.

The embodiments of the present invention are intended for use by all sexes and age groups. The embodiments of the present invention may be used while exercising, for general comfort, or as a fashion accessory. The embodiments of the present invention may be used as a device to keep hair out of a wearer's face/eyes, as a sweatband, or for any other purposes a person might wear a headband.

In general, Applicant's product line sold under the brand name "Sparkly Soul" (see, e.g., SparklySoul.com) utilizes the novel joining of a full-circular/360-degree outside elastic ribbon or material with a substantially full-circular/360-degree stretch velvet ribbon or material inside lining.

Multiple embodiments of the invention with different configurations are illustrated in the figures and described below. The features in each configuration are interchangeable with features in other configurations and any description provided above or in the parent applications which are incorporated by reference.

Figure 1B:
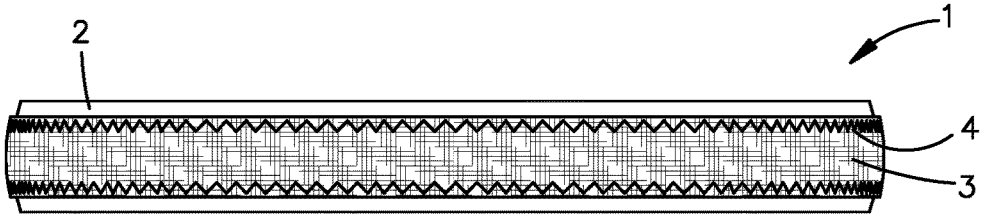
FIG. 1B shows the headband of FIG. 1A in an alternate view.
Figure 2A:
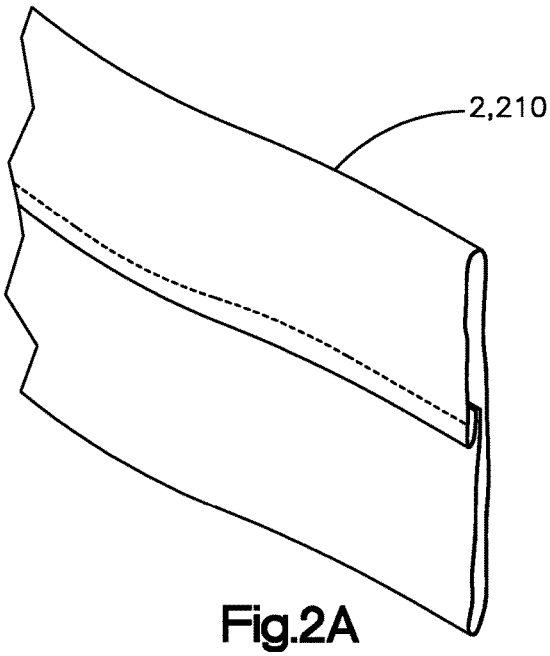
FIG. 2A shows an example of an elastic outside that is folded.
Figure 2B:
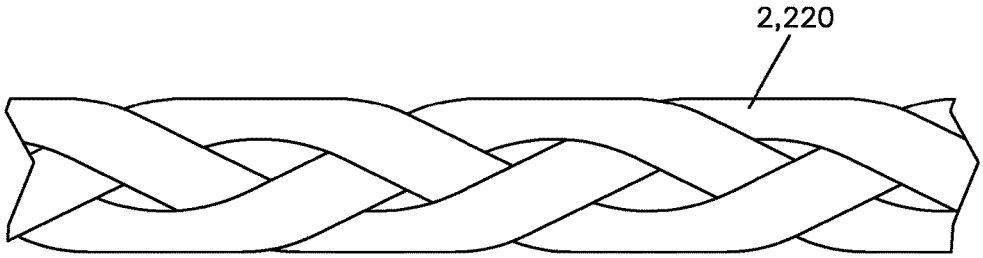
FIG. 2B shows an example of an elastic outside that is braided.

In FIGS. 1A and 1B, an embodiment of the present invention is illustrated, where a headband 1 includes an elastic outside 2 and an inside lining 3. The elastic outside 2 is made of a material that has an elasticity. The elastic outside 2 can be one piece as illustrated herein. A top portion of the elastic outside forms the outside 110 of the headband 1. The elastic outside 2 can be made of a ribbon and/or material. The material of the elastic outside 2 may be a flat, cut, folded 210 (shown in FIG. 2A), and/or braided 220 (shown in FIG. 2B) to be a desired width. Preferably, the elastic outside 2 is a ribbon or material that is cut to a desired length. Aesthetically, this creates a cleaner edge. Also, there is not a seam either visible or rubbing against the wearer's head. When the material of the elastic outside 2 is folded 210, the material is bent over on itself so that one part of the elastic outside 2 covers the other part. For example, the material of the elastic outside 2 can be folded over one edge substantially in half such that one edge of the elastic outside 2 is a fold and the seam is on the opposite edge. The material can be folded over the top edge of the elastic outside 2 or the bottom edge. In other embodiments of the present invention, the material can preferably be folded over two opposite edges such that the edges of the elastic outside 2 are folds and the seam is proximate to the middle of the elastic outside 2. The velvet inside lining 3 can cover the seam such that the seam does not rub against the wearer's head. This provides a variety of different designs and finishes to the headband 1. Regardless of the preparation of the elastic outside 2, the inside lining 3 is connected to the bottom of the elastic outside 2 to provide a grip without snagging the wearer's hair. Further, the headband 1 maintains elasticity as the elastic outside 2, even if braided, is made of a material with elasticity.

The inside lining 3, similar to the elastic outside 2, also has an elasticity. A bottom portion of the inside lining 3 forms the inside 120 of the headband 1. In at least one embodiment of the present invention, the inside lining 3 can form at least 75% of the inside of the headband 1. In other embodiments of the present invention, the inside lining 3 can form about 95% of the inside of the headband 1.

At least the bottom portion of the inside lining 3 is made of a stretch velvet material that forms a gripping portion. In at least one embodiment of the present invention, the entire inside lining 3 is made of a stretch velvet material. Having a stretch velvet inside lining 3 allows the headband 1 to grip hair without snagging the hair. Accordingly, the headband 1 does not slip or provide issues for the wearer. Additionally, the stretch velvet inside lining 3 creates a comfortable feel on a wearer's head so as not to cause a headband headache. If the stretch velvet inside lining 3 was not present, any plain ribbon or material would slip right off of a wearer's head, regardless of elasticity. In at least one embodiment of the present invention, the stretch velvet inside lining 3 is preferably made of approximately 80% polyamide and approximately 20% elastomer. Alternatively, the percentage of polyamide can be as high as 95% and as low as 70% while the percentage of elastomer can be as low as 5% and as high as 30%.

As shown in FIGS. 1A and 1B, the elastic outside 2 has a width that is greater than a width of the inside lining 3. In other words, the width of the inside lining 3 is less than the width of the elastic outside 2 such that the elastic outside 2 ribbon or material can be seen on either side of the inside lining 3. The width of the elastic outside 2 and the inside lining 3 can both vary. Also, the ratio of the widths between the elastic outside 2 and the inside lining 3 can vary. The width of the headband can be, for example, ⅜-inch or ⅝-inch.

The inside lining 3 as shown in FIGS. 1A and 1B is one strip that is preferably aligned with the middle of the elastic outside 2. The inside lining 3 is preferably connected to the elastic outside 2 by two rows of stitching 4 that are proximate to the edges of the inside lining 3. The two rows of stitching 4 are proximate the outside edges of the inside lining 3. The distance of the stitching 4 from the edges of the inside lining 3 can vary. In other embodiments of the present invention, one, three, or more rows of stitching 4 can be used to connect the inside lining 3 and the elastic outside 2 while maintaining elasticity of the headband.

Figure 3:
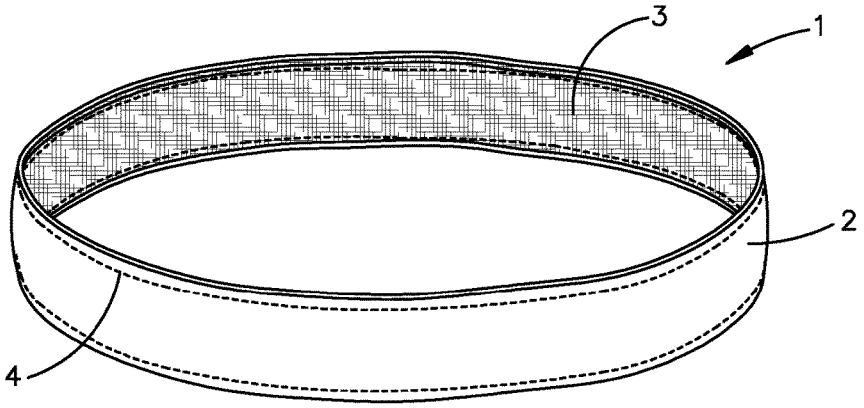
FIG. 3 shows an example of a headband where the elastic outside has the same width as the inside lining.

As shown in FIG. 3, the width of the inside lining 3 can be substantially the same as the width of the elastic outside. The widths of the elastic outside 2 and the inside lining 3 may vary. Together, the elastic outside 2 and the inside lining 3 provide an entirely elastic headband 1.

Figure 4A:
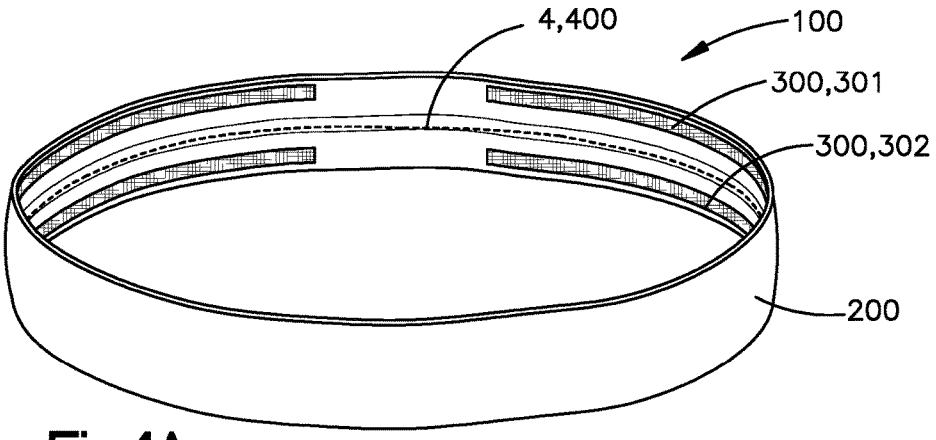
FIG. 4A shows an example of a headband where the inside lining is adjacent to the two outer edges of the headband.
Figure 4B:
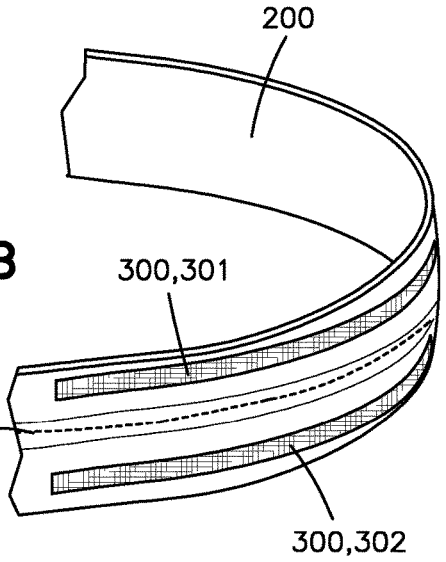
FIG. 4B shows the headband of FIG. 3A in an alternate view.

While the embodiments in FIGS. 1A, 1B, and 3 provide an inside lining 3 that align substantially with the middle of the elastic outside 2, the inside lining 300 can be situated proximate to the edges of the elastic outside 200, as shown in FIGS. 4A and 4B. Two strips of inside lining 301, 302 are aligned towards the edge of the headband 100 on the inside of the headband 100 and substantially parallel to one another, similar to train tracks. In other embodiments of the present invention, the strips of inside lining 301, 302 do not have to be parallel and can have different variations and designs. In yet other embodiments of the present invention, more than two strips of inside lining 3 can be connected to the elastic outside 2. The full-circular/360-degree inside lining 300 spans the circle of the headband 100. The inside lining 300 can also have some breaks in the circle. The cumulative amount of inside lining 300, though, can form between about 270-degrees and about 360-degrees of the inside of the headband 100 regardless of the number of breaks or the size of each break. In other embodiments of the present invention, the inside lining 300 may span the entire 360-degrees of the headband 100. As two strips of the inside lining 301, 302 span the outer edges of the headband, stitching 400 can be in the middle of the headband 100.

Figure 5A:
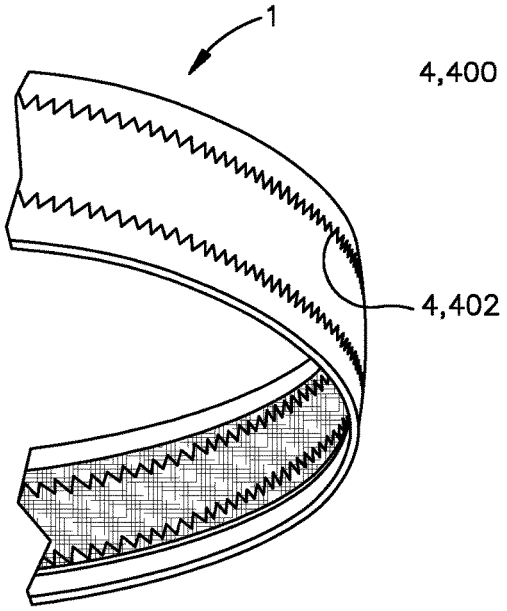
FIG. 5A shows an example of a headband with a zigzag stitch.
Figure 5B:
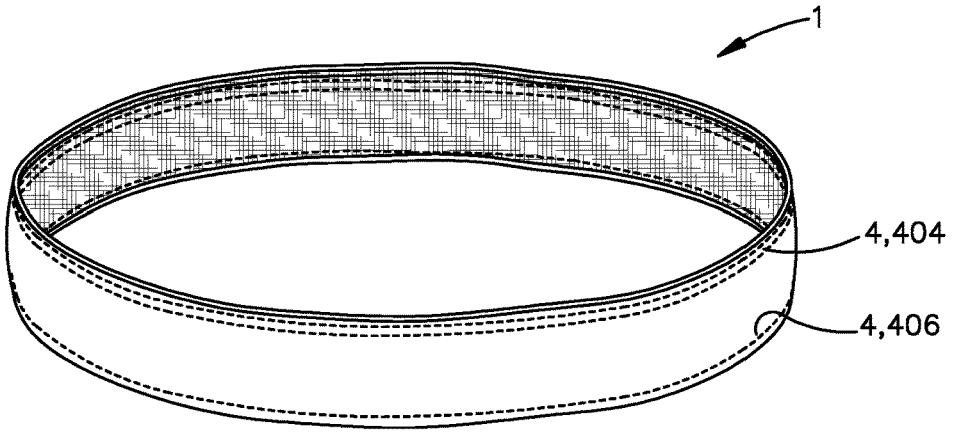
FIG. 5B shows an example of a headband with a single needle stitch and a double needle stitch.
Figure 5C:
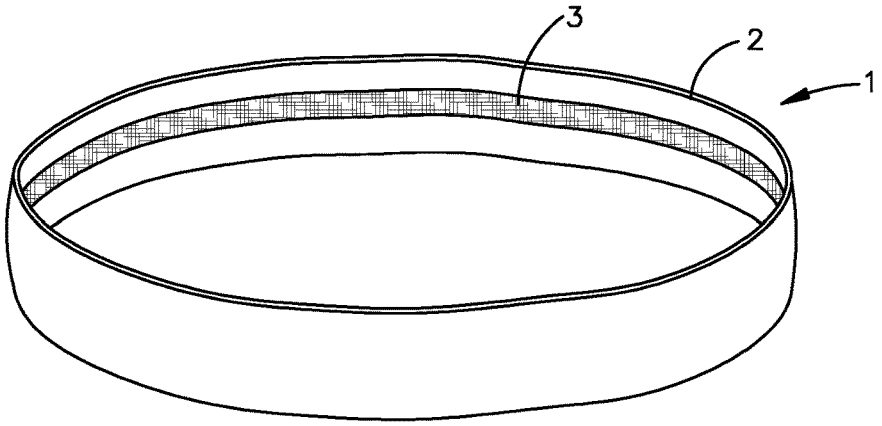
FIG. 5C shows an example of a headband where an inside lining is bonded to an elastic outside.

As shown in FIGS. 5A-5C, various securing methods to connect the inside lining 3 and the elastic outside 2 may be used to maintain the elasticity of the headband. The securing method can be stitching. Stitching includes utilizing thread that is passed through and connects the elastic outside 2 and the inside lining 3 as long as the integrity of the stitch is not compromised when stretched. The stitching can be, for example but not limited to, zigzag stitching 402 as shown in FIG. 5A, single double needle stitching, double needle stitching 404 or single needle stitching 406 as shown in FIG. 5B, single double needle stitching, lock stitch, overlock stitch, flat lock stitch, chain stitch, stretch stitching, tricot stitching, merrow stitching, or any other suitable stitching known by a person of ordinary skill in the art such that the elasticity of the headband 1 is maintained. In other words, the headband 1 can be stretched due to its 360-degree elasticity without a decline of the integrity of the stitching. Preferably, a double needle stretch stitching method is utilized so that the stitching does not pop when the two pieces of elastic material are connected and stretched.

Another method for connecting the inside lining 3 and the elastic outside 2 is by "bonding" as shown in FIG. 5C. Bonding, as understood by a person of ordinary skill in the art, is the process of pressing fabric to bond or adhere to each other. Further, the elasticity of the headband 1 is maintained. Bonding has a wide range of applications and is an effective complement to traditional machine sewing stitching. Bonding can be utilized separate from or in conjunction with stitching. Various securing methods may be used to secure the inside lining 3 to the elastic outside 2 including any type of bonding, adhesive, tape, or fusion methods including but not limited to a fusible bonding web. Heat may be used to promote bonding where heat is transferred to the adhesive or bonding material such that the inside lining 3 is bonded, adhered, or connected to the elastic outside 2. These securing methods of stitching or bonding can also be used to connect different elastic outside pieces with one another or to connect different decorations such as bows, ribbons, or flowers.

Figure 6A:
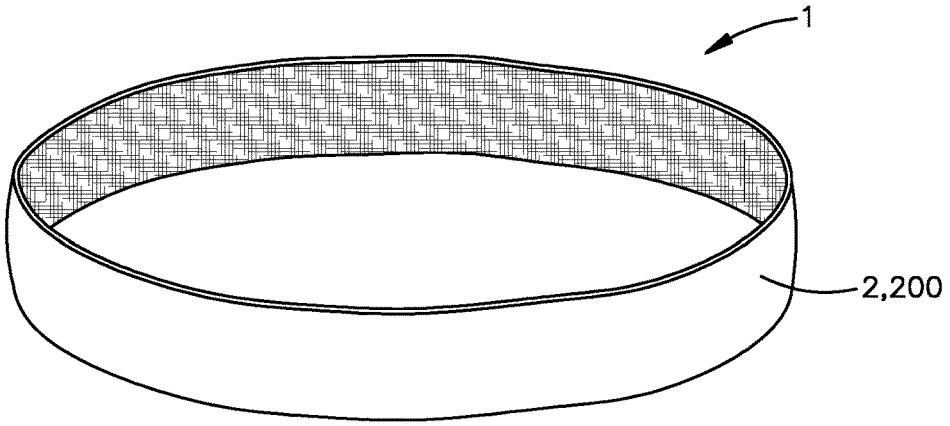
FIG. 6A shows an example of a headband where an elastic outside is plain.
Figure 6B:
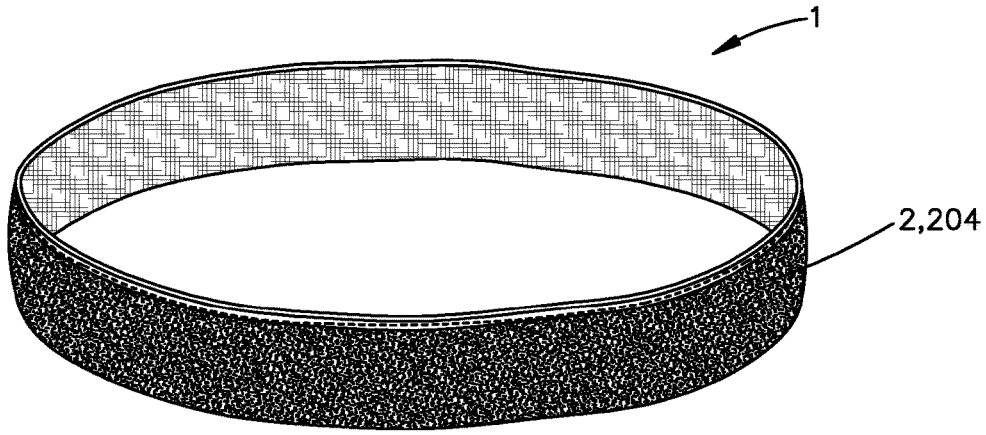
FIG. 6B shows an example of a headband where an elastic outside is metallic.
Figure 6C:
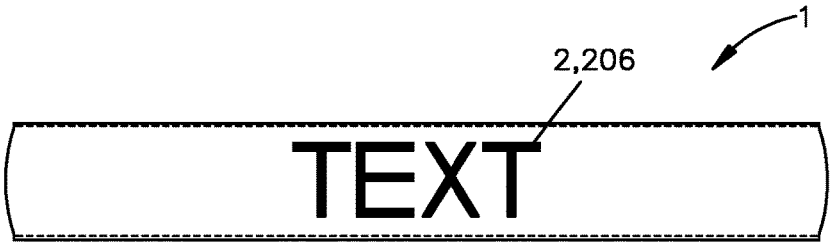
FIG. 6C shows an example of a headband where an elastic outside includes print.
Figure 6D:
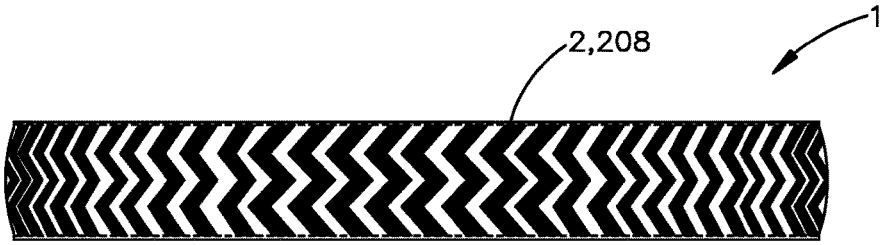
FIG. 6D shows an example of a headband where an elastic outside is patterned.
Figure 7:
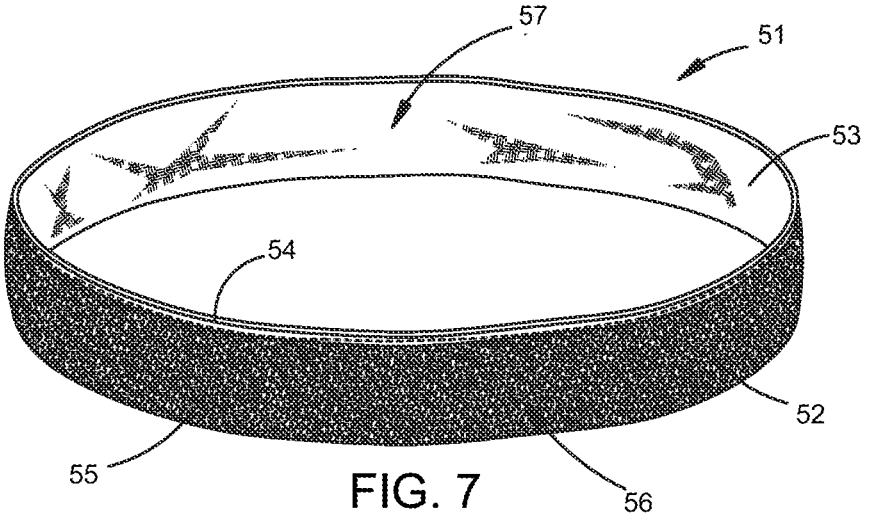
FIG. 7 is a top/side perspective view of a headband with a 360-degree glitter pattern on the outside thereof.
Figure 8:
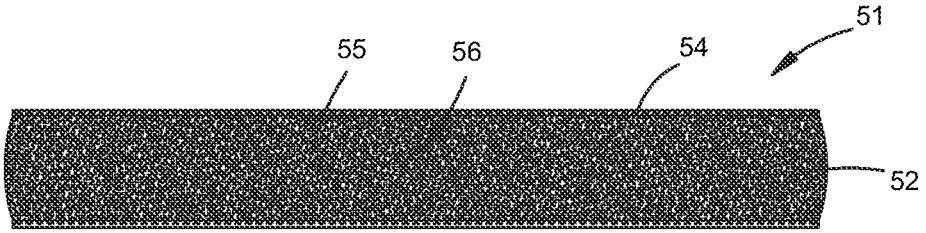
FIGS. 8 and 9 are front and top views, respectively, of a headband with a 360-degree glitter pattern as shown in FIG. 7.
Figure 9:
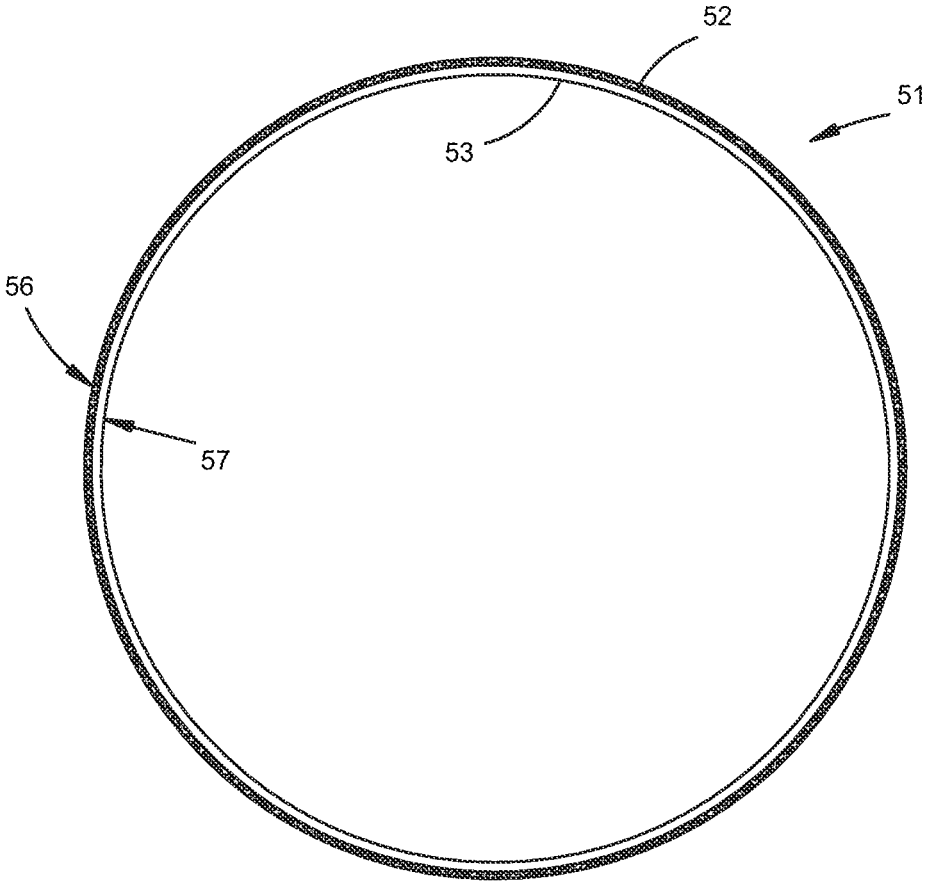
Figure 10:
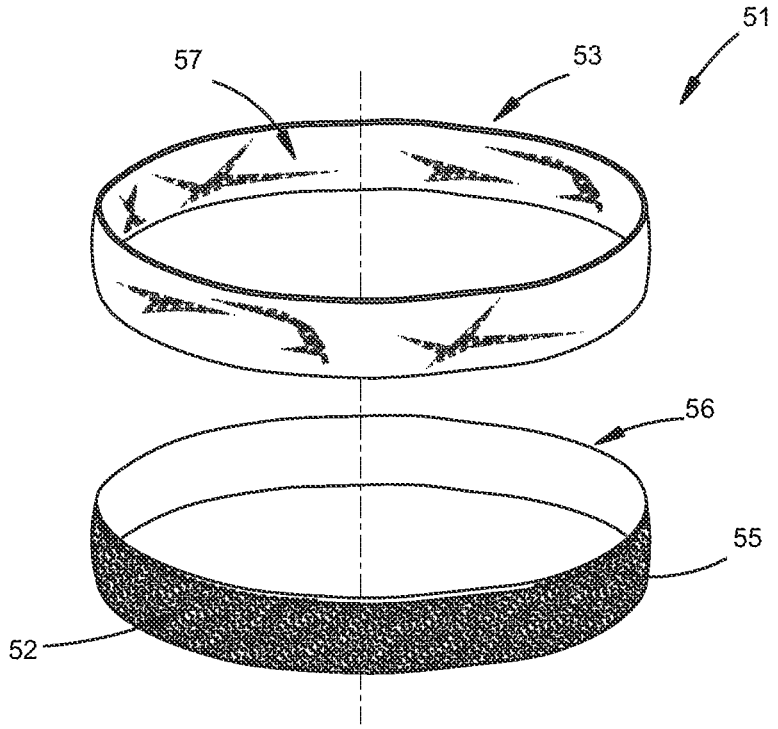
FIG. 10 is an exploded view of a headband with a 360-degree glitter pattern as shown in FIG. 7, showing the stretch velvet ribbon and the elastic glitter ribbon.

As shown in FIGS. 6A-6D, the elastic outside 2 can have different styles. The elastic outside 2 can have a plain outer surface 202 as illustrated in FIG. 6A. The elastic outside 2 can also be a ribbon or material that includes a metallic as in FIG. 6B. The metallic material can be one color or multiple colors. The elastic outside 2 can further include logos, letters, print, or other indicia as shown in FIG. 6C or one or more patterns as shown in FIG. 6D. Patterns can include chevron, polka dots, stripes, or other suitable or desired designs. The elastic outside 2 may be of various combinations of content and compositions. Patterns, logos, print or other indicia can be printed onto the elastic outside 2 with various printing methods such as ink, foil, laser, heat transfer, sublimation, and other suitable methods. Decorations such as bows, ribbon, or flowers can also be connected to the elastic outside 2. To further decorate the headband 1, the elastic outside 2 can include various textured ribbon, fabrics, and fasteners including but not limited to sequins, spandex, polyester blends, beading, silicone, toggles, tapes, buttons, hooks, sliders, Velcro, gimp, and/or puff paint. As such, the elastic outside 2 and the inside lining 3 can be the same color, or in other embodiments, different colors. In yet other embodiments, the elastic outside 2 and/or the inside lining 3 can each have multiple colors. Any combination of the above styles can be utilized as desired in the decoration of the headband 1. For example, the headband 1 can have a pattern with printed letters and logos and further include a bow(s) or flower(s). These designs and styles can be consistent throughout the 360-degrees of the headband 1, or the designs and styles can provide only parts of the headband 1.

As depicted in the figures, the headband 51 of an embodiment of the present invention is made from an elastic glitter ribbon 52 stitched onto a stretch velvet ribbon 53 using a stretch and stitch method. In the stretch and stitch method, both ribbons 52, 53 are stretched out and then stitched together, which maintains the elasticity of the two ribbons. The stretch and stitch method of joining the ribbons provides for the most reliability, durability, and visual appeal. If a standard stitch was used to join the two ribbons, the elasticity of the two ribbons would decrease or be taken away entirely. In an embodiment of the present invention, the stitch/thread 54 is visible on the outside of the headband 51. In another embodiment of the present invention, the stitch/thread is not visible on the outside of the headband.

After the elastic glitter ribbon 52 is stitched onto the stretch velvet ribbon 53 using the stretch and stitch method, the ends of both the elastic glitter ribbon 52 and the stretch velvet ribbon 53 are connected to make the outside of the headband 51 have a 360-degree view of the glitter 55 with no "break." The connection of the ends of the elastic glitter ribbon 52 and the stretch velvet ribbon 53 may be through the stitching together of the ends or the like, or through any means known in the art for connecting the ends of material for making headbands.

The bottom surface of the stretch velvet ribbon 53 forms the inside surface 57 of the headband 51. In an embodiment of the present invention, the bottom surface of the stretch velvet ribbon 53 is made of a velvet material. The velvet bottom prevents slipping and snagging (i.e., hair pulling) on a wearer's head. Additionally, the velvet inside surface 57 of the headband 51 creates a comfortable feel on a wearer's head so as not to cause a headband headache. If the velvet bottom surface of the stretch velvet ribbon 53 was not present in an embodiment of the present invention, any plain ribbon (elastic or not) would slip right off a wearer's head. This is because the velvet material acts to grip the hair, without snagging the hair of a wearer. This is especially true when exercising.

In an embodiment of the present invention, the stretch velvet ribbon 53 is lush with a resplendent look and is woven with the elasticity required for the headband 51 of the embodiments of the present invention. The stretch velvet ribbon 53 may be a variety of colors and a variety of sizes. In an embodiment of the present invention the stretch velvet ribbon 53 is made of approximately 80% nylon and approximately 20% elastomer (a person of ordinary skill in the art would under that "approximately" used in this context means "within a few percentage points"). However, one skilled in the art will understand that the embodiments of the present invention are not limited to the materials described herein for either the elastic glitter ribbon 2 or the stretch velvet ribbon 3.

Moreover, the elastic properties of the headband 51 of the embodiments of the present invention prevent headband headaches because the fit of the headband 51 is not too tight and the headband 1 does not have a limited flexibility. The headband 51 of the embodiments of the present invention molds to a wearer's head because the headband 51 encircles the entire head with no break.

The embodiments of the present invention provide for the most functionality and highest level of visual appeal. In other embodiments of the present invention the elastic glitter ribbon 52 may be replaced with an elastic ribbon that includes, but is not limited to, various textured ribbons, fabrics, and fasteners including but not limited to sequins, spandex, polyester blends, beading, silicone, toggles, tapes, buttons, hooks, sliders, Velcro, gimp, and/or puff paint.

The embodiments of the present invention are improvements from the headbands of the prior art. For example, many similar prior art headbands do not stretch for 360-degrees of the headband—they use a piece of black elastic on the back of the headband to provide the "stretch" on the headband. Additionally, the gripping portion of prior art headbands does not wrap around the entire head of the wearer—the headband stops and the remainder is plain elastic. While most of the headbands of the prior art market their headbands as "no slip," there is still a degree of slide due to the grip not going all the way around the headband, and therefore not going all the way around the wearer's head. These headbands of the prior art cause a headband headache due to their lack of elasticity.

As discussed above, the embodiments of the present invention may be manufactured in many different colors and/or color combinations. For example, in an embodiment of the present invention, the elastic glitter ribbon 52 and the stretch velvet ribbon 53 may be color coordinated, and in another embodiment they may be different colors.

In another embodiment of the present invention, the elastic glitter ribbon 52 is substituted for an elastic ribbon that contains no glitter.

The invention claimed is:

1. A 360 degree headband consisting of:

an outer layer, the outer layer formed of a single piece of material formed in a loop, a first end of the single piece of material being connected to a second end of the single piece of material at a seam, wherein the entire loop of the outer layer exhibits a uniform elasticity, and wherein the entire loop of the outer layer has a uniform width; and an inner layer consisting of a piece of velvet material attached to the outer layer la stitching, wherein the inner layer exhibits elasticity, wherein a long axis of the piece of velvet material is aligned with a long axis of the single piece of material of the outer layer, wherein the entire 360 degrees of the headband exhibits elasticity.

2. The 360 degree headband of claim 1, wherein the outer layer is formed of an elongated ribbon.

3. The 360 degree headband of claim 1, wherein the inner layer consisting of velvet material is a 360 degree continuous layer of velvet material.

4. The 360 degree headband of claim 3, wherein the outer layer and the 360 degree continuous layer of velvet material are concentric.

5. The 360 degree headband of claim 1, wherein the inner layer consisting of velvet material is formed of an elongated ribbon of velvet material, wherein a first end of the elongated ribbon of velvet material is connected to a second end of the elongated ribbon of velvet material at a seam.

6. The 360 degree headband of claim 1, wherein the velvet material comprises nylon and elastomer.

7. The 360 degree headband of claim 1, wherein the stitching is visible on an outer surface of the 360 degree headband.

8. The 360 degree headband of claim 1, wherein the stitching is not visible on an outer surface of the 360 degree headband.

9. The 360 degree headband of claim 1, wherein the width of the outer layer is ⅜ inch.

10. The 360 degree headband of claim 1, wherein the width of the outer layer is ⅝ inch.

11. The 360 degree headband of claim 1, wherein the inner layer is attached to the outer layer by zig zag stitching.

12. The 360 degree headband of claim 1, wherein the inner layer is attached to the outer layer by stretch-and-stitch stitching.

* * * * *